US008622189B2

(12) United States Patent
Morino et al.

(10) Patent No.: US 8,622,189 B2
(45) Date of Patent: Jan. 7, 2014

(54) BANKNOTE RECOGNITION AND COUNTING MACHINE AND MONEY COUNTING METHOD

(75) Inventors: Hajime Morino, Kasukabe (JP); Toshio Numata, Kawasaki (JP); Shinji Matsuura, Tokyo-To (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 30 days.

(21) Appl. No.: 13/256,554

(22) PCT Filed: Mar. 19, 2009

(86) PCT No.: PCT/JP2009/055470

§ 371 (c)(1),
(2), (4) Date: Sep. 14, 2011

(87) PCT Pub. No.: WO2010/106667

PCT Pub. Date: Sep. 23, 2010

(65) Prior Publication Data

US 2012/0006646 A1 Jan. 12, 2012

(51) Int. Cl.
*G07F 7/04* (2006.01)

(52) U.S. Cl.
USPC ..... 194/206

(58) Field of Classification Search
USPC ..... 194/206, 215, 216, 217; 209/534; 235/379
See application file for complete search history.

(56) References Cited

U.S. PATENT DOCUMENTS

| | | | | |
|---|---|---|---|---|
| 4,830,742 | A * | 5/1989 | Takesako | 209/534 |
| 6,179,704 | B1 | 1/2001 | Suzuki | |
| 7,980,394 | B2 * | 7/2011 | Otsuka | 209/534 |
| 2006/0182330 | A1 * | 8/2006 | Chiles | 382/135 |
| 2006/0283685 | A1 * | 12/2006 | Cousin | 194/217 |
| 2007/0069007 | A1 * | 3/2007 | Molbak | 235/379 |

FOREIGN PATENT DOCUMENTS

| | | |
|---|---|---|
| JP | 63-286993 | 11/1988 |
| JP | 2007-065776 | 3/2007 |

OTHER PUBLICATIONS

European Search Report (Application No. 09841872.6—PCT/JP2009/055470) (7 pages—dated Jun. 2, 2013).

* cited by examiner

*Primary Examiner* — Mark Beauchaine
(74) *Attorney, Agent, or Firm* — Renner, Kener, Greieve, Bobak, Taylor & Weber

(57) ABSTRACT

In a banknote recognition and counting machine (10), information concerning a count result on coins is inputted through an input unit (32, 53), and then the information concerning the count result on the coins inputted through the input unit (32, 53) is sent to a control unit (50). Thereafter, information concerning a count result on one or more banknotes counted by a recognition and counting unit (24) and the information concerning the count result on the coins inputted through the input unit are outputted, through an output unit (32p, 34, 52, 38).

8 Claims, 7 Drawing Sheets

EUR

| DENOM. | PCS. | AMOUNT |
|---|---|---|
| 500 | 2 | 1,000 |
| 200 | 2 | 200 |
| 50 | 1 | 50 |
| BILL.TOTAL | 5 | 1,250 |

| DENOM. | PCS. | AMOUNT |
|---|---|---|
| 0.5 | 1 | 0.5 |
| 0.02 | 1 | 0.02 |
| COIN.TOTAL | 2 | 0.52 |

TOTAL 1,250.52

FIG. 7

BANKNOTE RECOGNITION AND COUNTING MACHINE AND MONEY COUNTING METHOD

CROSS-REFERENCE TO RELATED APPLICATION

This application is the National Stage of International Application No. PCT/JP2009/055470, filed on Mar. 19, 2009.

FIELD OF THE INVENTION

The present invention relates to a banknote recognition and counting machine adapted for recognizing and counting one or more banknotes, and also relates to a money counting method for counting money by using the banknote recognition and counting machine.

BACKGROUND ART

In the past, various types of machines have been used as the banknote recognition and counting machine adapted for recognizing and counting the banknotes. In general, the banknote recognition and counting machine includes a casing, a placing unit adapted for placing thereon the banknotes and feeding such placed banknotes, one by one, into the casing, a recognition and counting unit provided in the casing and adapted for recognizing and counting the banknotes, respectively fed into the casing from the placing unit, and a stacking unit adapted for stacking therein the banknotes that have been recognized and counted by the recognition and counting unit and then fed to the stacking unit. Further, a control unit is provided to this banknote recognition and counting machine, such that a count result on the banknotes is sent to this control unit from the recognition and counting unit. In this case, information concerning a recognition result on the banknotes recognized by the recognition and counting unit is outputted by an output unit. For instance, a printer is used as the output unit, and the information concerning the recognition result on the banknotes recognized by the recognition and counting unit, more specifically, the number of the banknotes for each denomination of money or total amount of money of the banknotes, respectively recognized by the recognition and counting unit, is printed by this printer.

Further, in the case of outputting a count result on coins as well as outputting the count result on the banknotes, an external machine or device, such as a personal computer or the like, is provided. Namely, in this case, the banknote recognition and counting machine adapted for recognizing and counting the banknotes and a coin recognition and counting machine adapted for recognizing and counting the coins are respectively connected with the external machine, and the information concerning the count result on the banknotes is sent to the external machine from the banknote recognition and counting machine, while the information concerning the count result on the coins is sent to the same external machine from the coin recognition and counting machine. Thus, the information concerning the count result on the banknotes and the information concerning the count result on the coins are respectively outputted from the same external machine.

In addition, as another approach for outputting the count result on the coins as well as outputting the count result on the banknotes, one method, as disclosed in U.S. Pat. No. 7,269,279B or JP6-36207B2, has been known. More specifically, in the U.S. Pat. No. 7,269,279B, a money handling machine, which is adapted for counting the banknotes by using a banknote counting unit as well as adapted for counting the coins by measuring the mass of the coins by using a coin balance, is disclosed. Meanwhile, in the JP6-36207B2, a money deposit machine, which includes the banknote recognition and counting machine and coin recognition and counting machine and is thus adapted for counting the banknotes by using the banknote recognition and counting machine as well as adapted for counting the coins by using the coin recognition and counting machine, is disclosed.

DISCLOSURE OF THE INVENTION

However, in the case of employing the method, in which the external machine, such as the personal computer or the like, is provided for outputting the count result on the coins as well as outputting the count result on the banknotes, and in which the banknote recognition and counting machine adapted for recognizing and counting the banknotes and the coin recognition and counting machine adapted for recognizing and counting the coins are respectively connected with the external machine, there is a need for providing the external machine, such as the personal computer or the like. Therefore, the entire production cost may be unduly increased.

More specifically, in the case of the money deposit machine disclosed in the above JP6-36207B2, each of the information concerning the recognition result on the banknotes and the information concerning the recognition result on the coins is sent to a teller's machine provided separately from the money deposit machine, as shown in FIG. 3 provided in the JP6-36207B2. Then, the information concerning each recognition result on the banknotes and coins is outputted on a display unit or printing unit of the teller's machine. Accordingly, for this money deposit machine disclosed in the JP6-36207B2, it is necessary to provide the external machine composed of the teller's machine, leading to rather increase of the entire production cost.

Meanwhile, for the money handling machine disclosed in the U.S. Pat. No. 7,269,279B, it is necessary to provide the coin balance for counting the coins, thus requiring an additional cost for installing this coin balance. Further, in the case of counting both of the banknotes and coins, the number of the banknotes is usually larger than the number of the coins. In other words, the number of the coins to be counted is usually quite small, as compared with the number of the banknotes to be counted. Therefore, it is rather inefficient to provide the coin balance, for separately counting such a small number of coins. Besides, the coins often include many denominations of money. Therefore, before the coin balance is used for counting such coins, it is necessary to once sort the coins, by hand, leading to rather deterioration of the working efficiency.

The present invention was made in light of such problems. Therefore, it is an object of this invention to provide a banknote recognition and counting machine that can output both of the information concerning the count result on the banknotes and the information concerning the count result on the coins, without the need for providing the external machine, such as the personal computer or the like. It is another object of this invention to provide a money counting method that can be used for outputting both of the information concerning the count result on the banknotes and the information concerning the count result on the coins, by using the banknote recognition and counting machine of this invention.

A banknote recognition and counting machine according to the present invention is configured to recognize and count banknotes and includes: a casing; a recognition and counting unit provided in the casing and configured to recognize and count one or more banknotes, put from the outside into the casing; a control unit connected with the recognition and counting unit and configured to receive a count result on one or more banknotes, sent from the recognition and counting unit; an input unit connected with the control unit and configured to allow information concerning a count result on coins to be inputted, the information concerning the count result on the coins, that has been inputted through the input unit, being sent to the control unit; and an output unit connected with the control unit and configured to output information concerning the count result on one or more banknotes counted by the recognition and counting unit and the information concerning the count result on the coins inputted through the input unit.

According to such a banknote recognition and counting machine, the information concerning the count result on the coins is inputted through the input unit, and then the information concerning the count result on the coins inputted through the input unit is sent to the control unit. Thereafter, the information concerning the count result on the banknotes counted by the recognition and counting unit and the information concerning the count result on the coins inputted through the input unit are respectively outputted from the output unit. Therefore, the count result on the banknotes can be outputted, as well as the count result on the coins can be outputted, by using the banknote recognition and counting machine provided for recognizing and counting the banknotes. As such, both of the information concerning the count result on the banknotes and the information concerning the count result on the coins can be outputted, without the need for providing the external machine, such as the personal computer or the like.

In the banknote recognition and counting machine according to the present invention, the input unit may include an operation unit provided to an outer surface of the casing and configured to send a command to the control unit.

Alternatively, the input unit may include a coin interface unit, that is connected, for communication, with a coin recognition and counting machine configured to recognize and count the coins, the coin interface unit receiving the information concerning the count result on the coins sent from the coin recognition and counting machine.

In the banknote recognition and counting machine according to the present invention, the output unit may be configured to output information concerning the total of the count result on one or more banknotes counted by the recognition and counting unit and the count result on the coins inputted through the input unit.

In this case, the output unit may be configured to output information concerning the total amount of money and/or information concerning the total number of money by denomination, in the total of the count result on one or more banknotes counted by the recognition and counting unit and the count result on the coins, inputted through the input unit.

In the banknote recognition and counting machine according to the present invention, the input unit may be capable of allowing the information concerning a manually-obtained count result on one or more banknotes that cannot be recognized by the recognition and counting unit, to be inputted, in addition to the information concerning the count result on the coins.

In the banknote recognition and counting machine according to the present invention, the banknote recognition and counting machine further including a memory unit connected with the control unit and configured to store therein the information concerning the count result on one or more banknotes counted by the recognition and counting unit and the information concerning the count result on the coins inputted through the input unit.

In this case, the memory unit may include a first memory part configured to store therein the information concerning the count result on one or more banknotes counted by the recognition and counting unit, and a second memory part configured to store therein the information concerning the count result on the coins, inputted through the input unit.

In the banknote recognition and counting machine according to the present invention, the output unit may include any one of: a display unit configured to display the information concerning the count result on one or more banknotes counted by the recognition and counting unit and the information concerning the count result on the coins inputted through the input unit; a printing unit configured to print the information concerning the count result on one or more banknotes counted by the recognition and counting unit and the information concerning the count result on the coins inputted through the input unit; an external interface unit connected, for communication, with an external machine and configured to send the information concerning the count result on one or more banknotes counted by the recognition and counting unit and the information concerning the count result on the coins inputted through the input unit, to the external machine; and a storage-medium writing unit configured to write the information concerning the count result on one or more banknotes counted by the recognition and counting unit and the information concerning the count result on the coins inputted through the input unit, in an external storage medium.

The money counting method of this invention is adapted for counting money by using a banknote recognition and counting machine configured to recognize and count banknotes, and includes: recognizing and counting one or more banknotes, put from the outside into a casing of the banknote recognition and counting machine, by using a recognition and counting unit; inputting information concerning a count result on coins, through an input unit; and outputting information concerning a count result on one or more banknotes counted by the recognition and counting unit and the information concerning the count result on the coins inputted through the input unit, through an output unit.

According to this money counting method, the banknotes, respectively put from the outside into the casing of the banknote recognition and counting machine, are recognized and counted by the recognition and counting unit, and the information concerning the count result on the coins is inputted through the input unit, and then the information concerning the count result on the banknotes counted by the recognition and counting unit and the information concerning the count result on the coins inputted through the input unit are outputted through the output unit. Therefore, this method can be used for outputting both of the information concerning the count result on the banknotes and the information concerning the count result on the coins, by using the banknote recognition and counting machine adapted for recognizing and counting the banknotes, without the need for providing the external machine, such as the personal computer or the like.

BRIEF DESCRIPTION OF THE DRAWINGS

FIG. 3 is a diagram illustrating details of an operation/display unit of the banknote recognition and counting machine shown in FIG. 1 and so on.

FIG. 4 is a block diagram illustrating a control system of the banknote recognition and counting machine shown in FIG. 1 and so on.

FIG. 5 is a flow chart for illustrating the operation for outputting the recognition result on the banknotes as well as outputting the recognition result on the coins, by using the banknote recognition and counting machine shown in FIG. 1 and so on.

FIGS. 6(*a*) through 6(*f*) respectively illustrate display contents on the display unit when the operation, as illustrated in the flow chart of FIG. 5, is performed in the banknote recognition and counting machine shown in FIG. 1 and so on.

FIG. 7 illustrates contents printed by the printing unit when the operation, as illustrated in the flow chart of FIG. 5, is performed in the banknote recognition and counting machine shown in FIG. 1 and so on.

DETAILED DESCRIPTION OF THE INVENTION

Figure 1A:
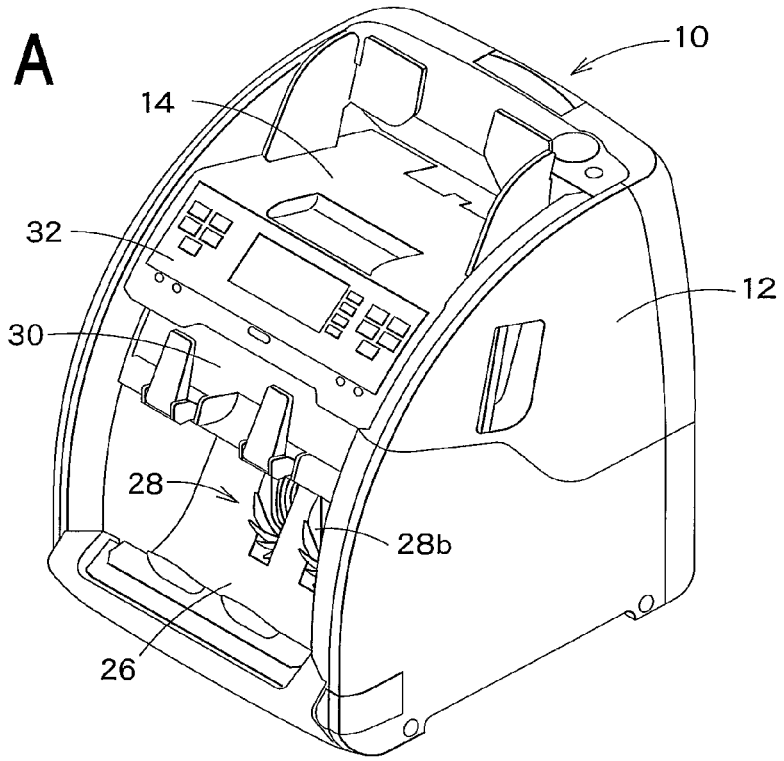
FIG. 1A is a perspective view provided for showing external appearance of the banknote recognition and counting machine related to one embodiment of the present invention, when a shutter is evacuated from an opening provided in a front face of the stacking unit.
Figure 1B:
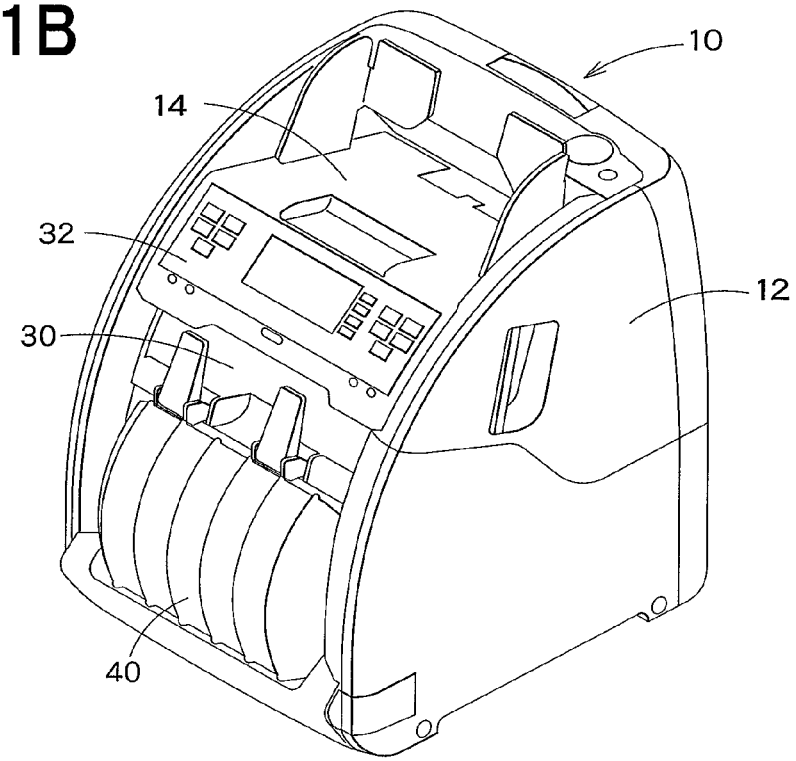
FIG. 1B is another perspective view provided for showing the external appearance of the banknote recognition and counting machine related to the embodiment of the present invention, when the shutter closes the opening provided in the front face of the stacking unit.
Figure 2:
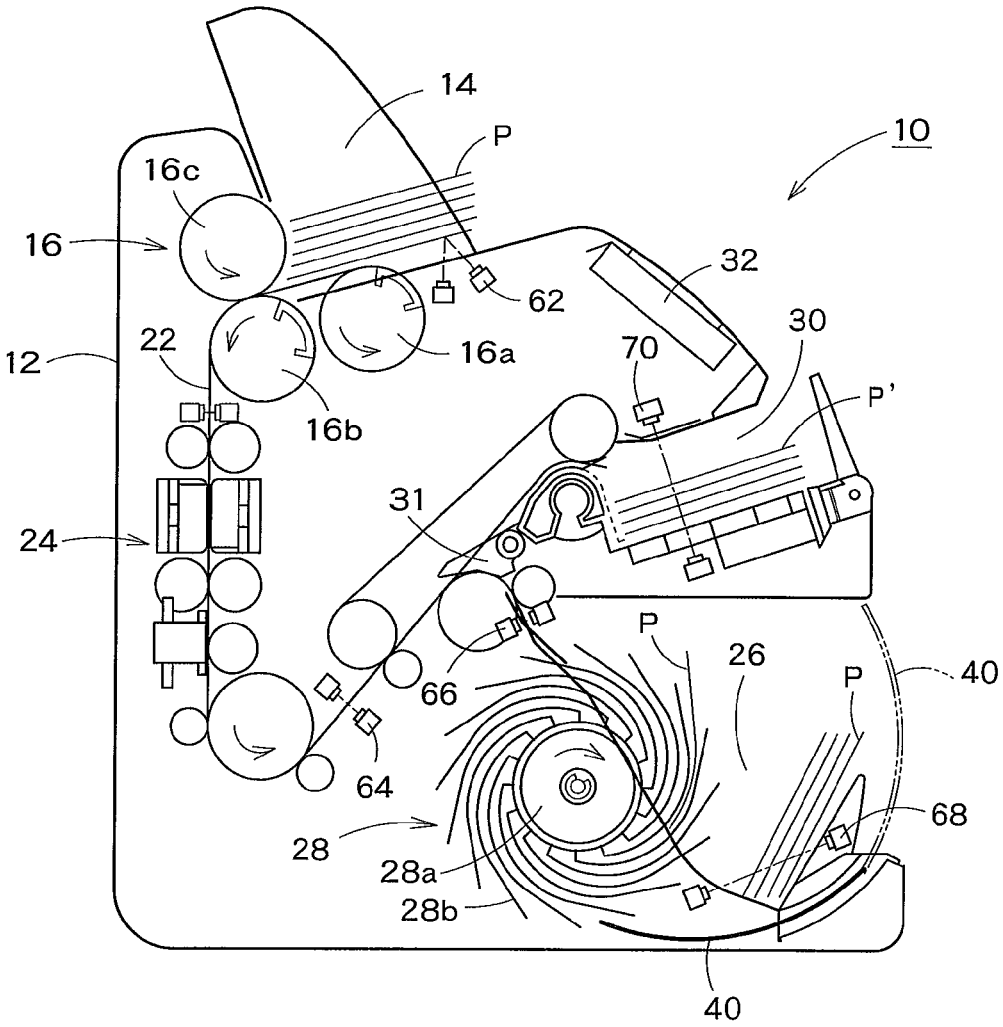
FIG. 2 is a diagram schematically illustrating the internal construction of the banknote recognition and counting machine shown in FIGS. 1A and 1B.
Figure 3:
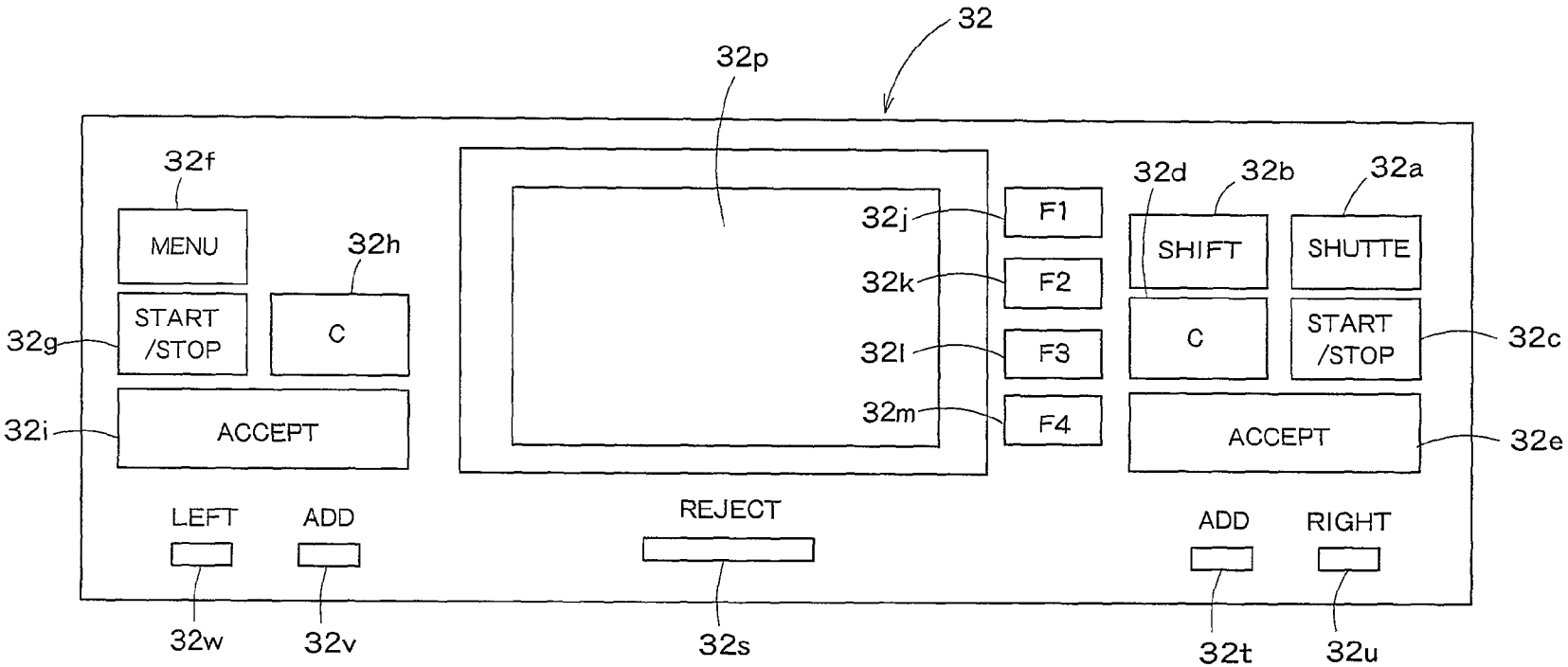
Figure 4:
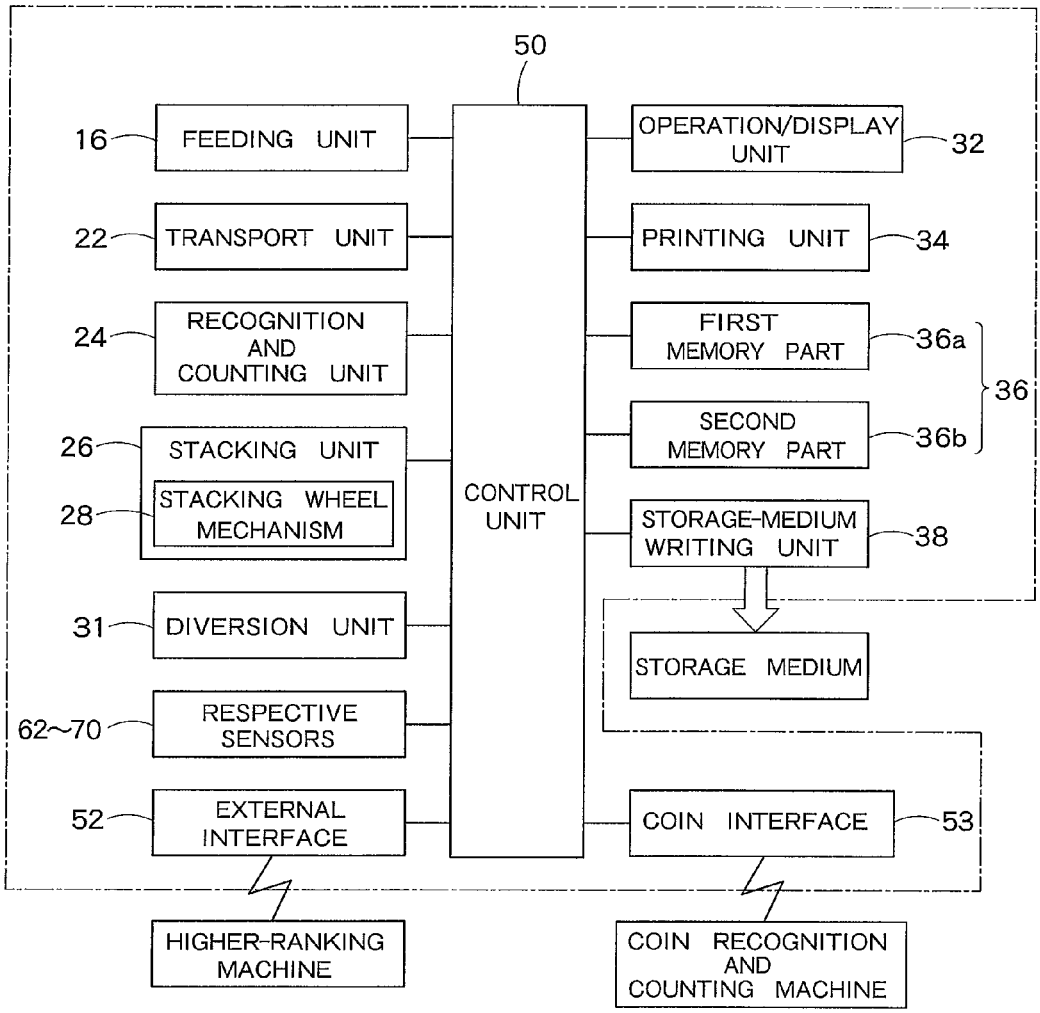
Figure 5:
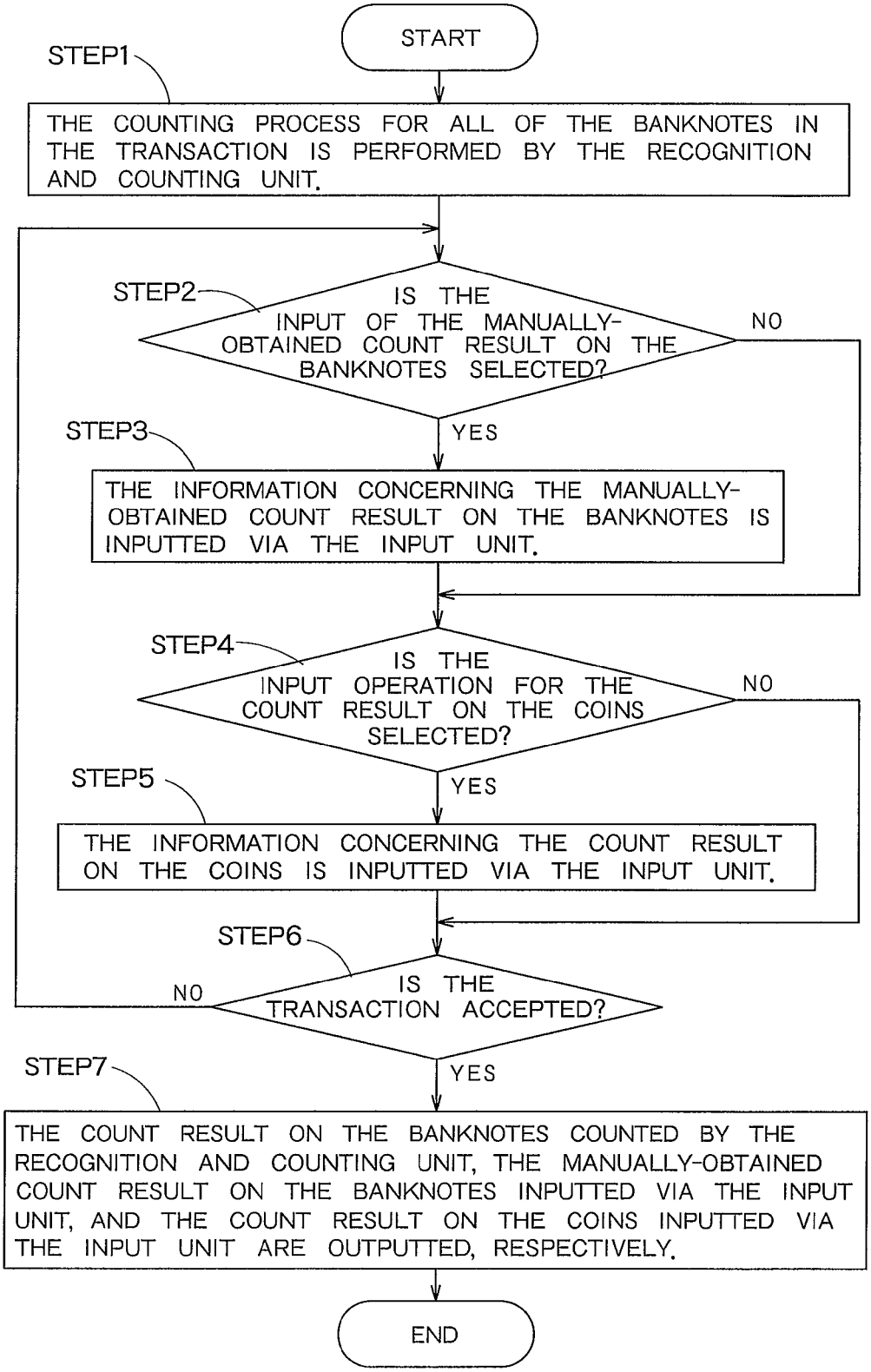
Figure 6:
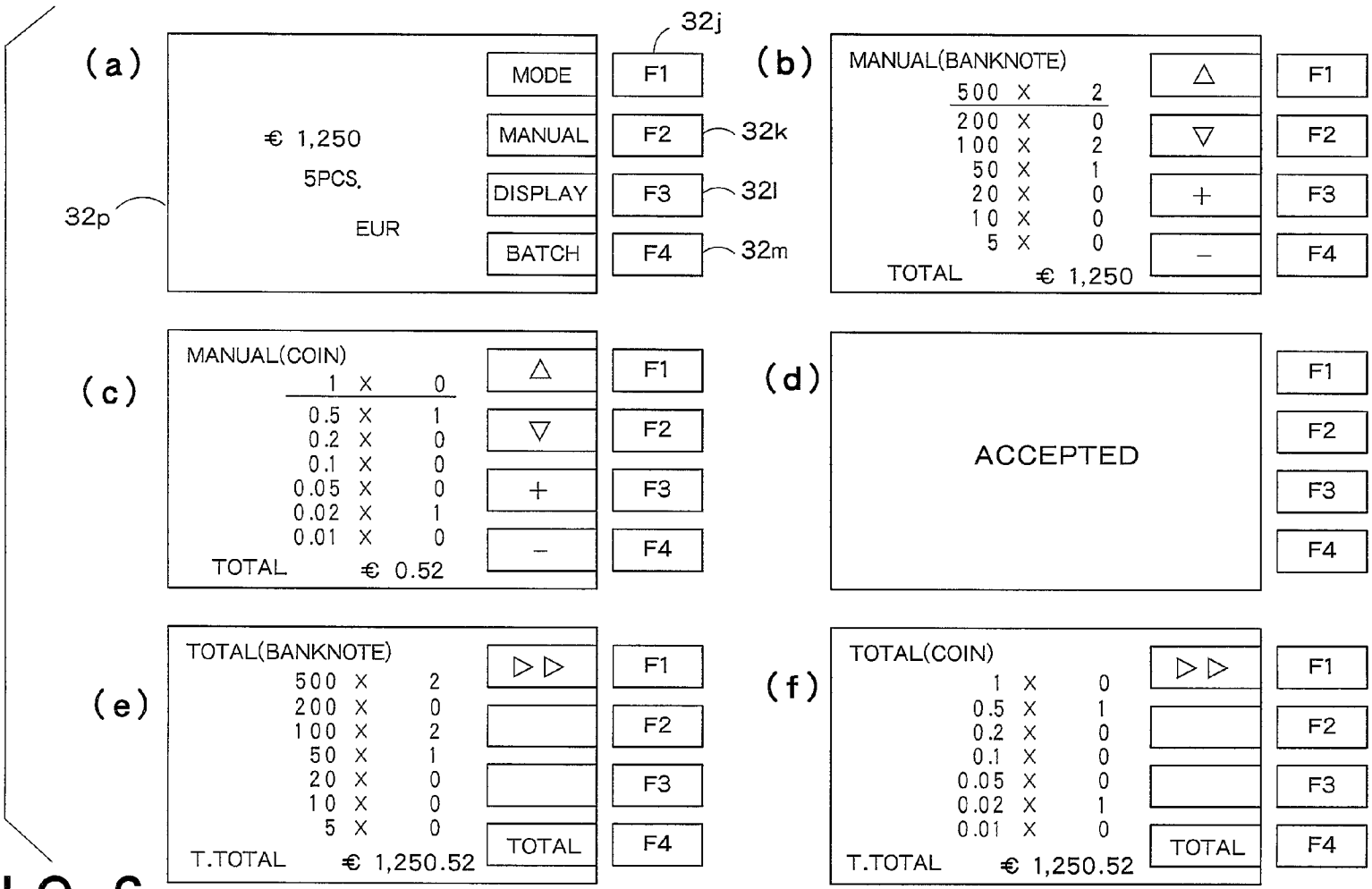

Hereinafter, one embodiment of the present invention will be described, with reference to the drawings. As used herein, FIGS. 1 through 7 are provided for respectively illustrating the banknote recognition and counting machine related to the embodiment. Of these drawings, FIGS. 1A and 1B respectively illustrate one perspective view of the banknote recognition and counting machine related to this embodiment. FIG. 2 schematically illustrates the internal construction of the banknote recognition and counting machine shown in FIGS. 1A and 1B, and FIG. 3 illustrates the details of the operation/display unit of the banknote recognition and counting machine shown in FIG. 1 and so on. FIG. 4 illustrates one exemplary control system of the banknote recognition and counting machine shown in FIG. 1 and so on. The flow chart of FIG. 5 illustrates the operation for outputting the recognition result on the banknotes as well as outputting the recognition result on the coins, by using the banknote recognition and counting machine shown in FIG. 1 and so on. FIGS. 6(*a*) through 6(*f*) are respectively provided for illustrating the display contents on the display unit when the operation, as illustrated in the flow chart of FIG. 5, is performed in the banknote recognition and counting machine shown in FIG. 1 and so on. FIG. 7 illustrates the contents printed by the printing unit when the operation, as illustrated in the flow chart of FIG. 5, is performed in the banknote recognition and counting machine shown in FIG. 1 and so on.

As illustrated in FIGS. 1A, 1B and 2, a banknote recognition and counting machine 10 includes a casing 12 and a placing unit 14 adapted for placing thereon a plurality of banknotes P to be respectively counted, in a stacked condition. Further, this banknote recognition and counting machine 10 includes a feeding unit 16 adapted for feeding each banknote P located at the lowermost layer of the banknotes P placed on the placing unit 14 in the stacked condition, one by one, into the casing 12, and a transport unit 22 adapted for transporting the banknotes P, respectively fed into the casing 12 by the feeding unit 16, one by one. In addition, a recognition and counting unit 24 adapted for recognizing and counting the banknotes P respectively fed into the casing 12 from the placing unit 14 is provided to the transport unit 22.

The feeding unit 16 includes a kicker roller 16*a* provided to be in contact with the surface of the banknote P located at the lowermost layer of the banknotes P placed on the placing unit 14 in the stacked condition, and a feed roller 16*b* located on the downstream side, in the feeding direction of the banknotes P, relative to the kicker roller 16*a*, and adapted for feeding the banknotes P, respectively kicked out by the kicker roller 16*a*, into the casing 12. Further, a gate roller (or reverse rotation roller) 16*c* is provided to be opposed to the feed roller 16*b*, with a gate part provided between the feed roller 16*b* and the gate roller 16*c*. Thus, each banknote P kicked out by the kicker roller 16*a* is passed through the gate part and then fed out, one by one, toward the transport unit 22 in the casing 12.

As shown in FIG. 2, the transport unit 22 is bifurcated into two transport paths, at a point located on the downstream side relative to the recognition and counting unit 24, and one of the two transport paths is connected with a stacking unit 26, while the other transport path is connected with a reject unit 30. With this configuration, the banknotes P that have been respectively recognized and counted by the recognition and counting unit 24 can be selectively fed to the stacking unit 26 or reject unit 30. An opening is provided in the front face of the stacking unit 26 (i.e., the face of the stacking unit 26 depicted on the right side in FIG. 2), such that the operator can take out the banknotes P respectively stacked in the stacking unit 26, via this opening. Further, another opening is provided in the front face of the reject unit 30, such that the operator can take out the banknotes P' respectively stacked in the reject unit 30, via this opening.

Further, as shown in FIG. 2, a diversion unit 31, including a diverter and a drive unit (not shown) for driving the diverter, is provided at the point where the transport unit 22 is bifurcated into the two transport paths. Due to this diversion unit 31, each banknote P that has been fed from the upstream side of the diversion unit 31 can be selectively fed to either one of the two bifurcated transport paths.

A stacking wheel mechanism 28 is provided on the back face side of the stacking unit 26 in the casing 12 (i.e., in a position located on the left side in the stacking unit 26 in FIG. 2). This stacking wheel mechanism 28 is composed of a stacking wheel 28*a* and a drive unit (not shown) for driving the stacking wheel 28*a*. This stacking wheel 28*a* is provided to be rotated in a clockwise direction (i.e., the direction indicated by an arrow depicted in FIG. 2) about a shaft extending in a substantially horizontal direction orthogonal to the sheet of FIG. 2. In this stacking wheel 28*a*, a plurality of vanes 28*b* are provided to extend outward, from an outer circumferential face of the wheel 28*a*, in a direction reverse to the rotation direction of the wheel 28*a* (i.e., the anticlockwise direction in FIG. 2). More specifically, such vanes 28*b* are arranged on the outer circumferential face of the stacking wheel 28*a*, at an equal interval, as shown in FIG. 2.

The stacking wheel 28*a* of the stacking wheel mechanism 28 is provided to be constantly rotated, by the driving unit, in the clockwise direction, as depicted in FIG. 2, during the operation of the banknote recognition and counting machine 10, thereby to receive the banknotes P, respectively fed from the transport unit 22, one by one. More specifically, the stacking wheel 28*a* can serve to receive each banknote P fed from the transport unit 22 between the two vanes 28*b* thereof, and then feed the banknote P received between the two vanes 28*a* into the stacking unit 26. In this way, the banknotes P can be fed to the stacking unit 26, one by one, from the stacking wheel 28*a*, as such the plurality of banknotes P can be stacked in the stacking unit 26.

In the banknote recognition and counting machine 10, as shown in FIGS. 1B, 2 and so on, a shutter 40 is provided to close the opening provided in the front face of the stacking unit 26, such that the opening in the front face of the stacking unit 26 can be selectively closed by the shutter 40. By means of a shutter drive unit (not shown) for driving the shutter 40, the shutter 40 can be moved, between an opening position, as depicted in FIG. 1A, in which the shutter 40 is evacuated from the opening in the front face of the stacking unit 26 in order to open the opening, and a closing position, as depicted in FIG. 1B, for closing the opening in the front face of the stacking unit 26. Namely, when the shutter 40 is located in the opening position as depicted in FIG. 1A, the shutter 40 is evacuated from the opening in the front face of the stacking unit 26 and thus the opening is opened, thereby allowing the operator to access the banknotes P respectively stacked in the stacking unit 26. Meanwhile, when the shutter 40 is located in the closing position as depicted in FIG. 1B, the opening in the front face of the stacking unit 26 is closed by the shutter 40, thus preventing the operator from accessing the banknotes P respectively stacked in the stacking unit 26. In FIG. 2, the shutter 40 located in the opening position is depicted by a solid line, while the shutter 40 located in the closing position is depicted by a two-dot chain line.

With the provision of the shutter 40 as described above, when the opening in the front face of the stacking unit 26 is closed by the shutter 40, as shown in FIG. 1B, the risk that the dust may be blown out toward the operator with the rotation of the stacking wheel 28*a* of the stacking wheel mechanism 28 can be effectively suppressed. Further, by closing the opening in the front face of the stacking unit 26 by the shutter 40, unwanted leakage of a sound generated from the interior of the banknote recognition and counting machine 10 toward the outside during the operation of this machine 10 can be successfully prevented.

Further, as shown in FIG. 2, various sensors are provided to the banknote recognition and counting machine 10. Specifically, to the placing unit 14, a placing-unit-residue banknote detection sensor 62 composed of a reflection-type optical sensor is provided for detecting whether or not there are some banknotes P remaining on the placing unit 14. Further, a diversion timing sensor 64 composed of an optical sensor is provided on the upstream side relative to the diversion unit 31 in the transport unit 22. In this case, the diverter of the diversion unit 31 can be optionally moved to either one of a first position for feeding each banknote P to the stacking unit 26 and a second position for feeding each banknote P to the reject unit 30 (in FIG. 2, the diverter of the diversion unit 31 is located in the position for feeding each banknote P to the stacking unit 26), at each timing on which the banknote P is detected by the diversion timing sensor 64. Thus, each banknote P transported by the transport unit 22 and then detected by the diversion timing sensor 64 is selectively fed to either one of the two transport paths by the diversion unit 31.

Additionally, a banknote tracking detection sensor 66 is provided to the transport path located on the side of the stacking unit 26, among the two transport paths bifurcated at the point where the diversion unit 31 is located. This banknote tracking detection sensor 66 is composed of a proper optical sensor adapted for detecting each banknote P fed to the transport path arranged on the side of the stacking unit 26. Namely, with the provision of this banknote tracking detection sensor 66, each banknote P that has been fed, by the diversion unit 31, to the transport path arranged on the side of the stacking unit 26 can be detected. Further, in the stacking unit 26, a stacking-unit banknote detection sensor 68 is provided. This stacking-unit banknote detection sensor 68 is composed of another optical sensor adapted for detecting whether or not there are some banknotes P stacked in the stacking unit 26. In addition, a reject-unit banknote detection sensor 70 is provided in the reject unit 30. This reject-unit banknote detection sensor 70 is composed of another proper optical sensor adapted for detecting whether or not there are some reject banknotes P' stacked in the reject unit 30.

Further, as shown in FIG. 4, the banknote recognition and counting machine 10 includes a control unit 50. This control unit 50 can serve to control each component of the banknote recognition and counting machine 10. More specifically, this control unit 50 is connected with each of the feeding unit 16, transport unit 22, recognition and counting unit 24, stacking unit 26 including the stacking-wheel drive mechanism 28, diversion unit 31 and the like. In this case, the recognition and counting result on each banknote P recognized by the recognition and counting unit 24 is sent to the control unit 50, while the control unit 50 sends an instruction signal to each of the feeding unit 16, transport unit 22, stacking unit 26, diversion unit 31 and the like, in order to control such components. Further, the control unit 50 is connected with each of the placing-unit-residue banknote detection sensor 62, diversion timing sensor 64, banknote tracking detection sensor 66, stacking-unit banknote detection sensor 68 and reject-unit banknote detection sensor 70, in order to receive each detection result of such sensors 62 to 70.

Further, the control unit 50 is connected with an operation/display unit 32. As shown in FIG. 1 and so on, the operation/display unit 32 is provided to a front face of the casing 12. In this case, the condition (or process condition) under which the banknotes P are handled or processed in the banknote recognition and counting machine 10, more specifically the information on the number for each denomination of money, total amount of money or the like of the banknotes P counted by the recognition and counting unit 24, can be displayed on the operation/display unit 32. Additionally, the operator can input various commands to the control unit 50 via the operation/display unit 32.

Now, referring to FIG. 3, more specific construction of the operation/display unit 32 will be described. As shown in FIG. 3, the operation/display unit 32 has a laterally elongated and substantially rectangular shape, and includes a display unit 32*p* composed of, for example, an LCD or the like, and provided at a laterally central part of the operation/display unit 32. In this case, the display unit 32*p* can serve to display the process condition for the banknotes P in the banknote recognition and counting machine 10, more specifically the information on the operational mode of the banknote recognition and counting machine 10, information on the number for each denomination of money, total amount of money or the like of the banknotes P counted by the recognition and counting unit 24, error information and the like.

On the right side of the display unit 32*p* in the operation/display unit 32, a SHUTTE (shutter) key 32*a*, a SHIFT key 32*b*, a START/STOP key 32*c*, a C (clear) key 32*d* and an ACCEPT key 32*e* are provided, respectively. Further, on the left side of the display unit 32*p* in the operation/display unit 32, a MENU key 32*f*, another START/STOP key 32*g*, another C (clear) key 32*h* and another ACCEPT key 32*i* are provided, respectively. Additionally, in a right adjacent portion relative to the display unit 32*p*, an F1 (a first function) key 32*j*, an F2 (a second function) key 32*k*, an F3 (a third function) key 321 and an F4 (a fourth function) key 32*m* are vertically arranged, in this order from the top. Furthermore, in a lower portion of the operation/display unit 32, a reject lamp 32*s*, an ADD (addition) lamp 32*t*, a RIGHT (right-side) lamp 32*u*, another ADD lamp 32*v* and a LEFT (left-side) lamp 32*w* are provided, respectively. It is noted that the respective function keys (i.e., the F1 key 32*j* to F4 key 32*m*) are provided to be selectively pushed down, upon performing various commands respectively displayed in a left adjacent portion in the display unit 32*p*.

For instance, when the operator pushes down the SHUTTE key 32*a* of the operation/display unit 32, the shutter 40 is moved from the opening position as depicted in FIG. 1A to the closing position as depicted in FIG. 1B or moved from the closing position as depicted in FIG. 1B to the opening position as depicted in FIG. 1A, by the shutter drive unit (not shown). In this manner, each time the SHUTTE key 32 is pushed down, the opening and closing operation of the shutter 40 is performed.

Further, as shown in FIG. 4, a printing unit 34 composed of, for example, a printer, is connected with the control unit 50 of the banknote recognition and counting machine 10. This printing unit 34 may be provided to the casing 12 of the banknote recognition and counting machine 10, or otherwise may be provided separately from the casing 12.

Further, a memory unit 36 is connected with the control unit 50 of the banknote recognition and counting machine 10. This memory unit 36 is composed of, for example, a flash memory, hard disk or the like, and is provided in the casing 12. In this case, the memory unit 36 serves to store therein information on the number for each denomination of money, total amount of money or the like of the banknotes P counted by the recognition and counting unit 24. In addition, an external interface 52 and a coin interface 53 are respectively connected with the control unit 50. Thus, the control unit 50 can transmit or receive a signal relative to a higher-ranking machine, such as a host computer or the like, via the external interface 52. Further, the control unit 50 can transmit or receive the signal relative to the coin recognition and counting machine provided for recognizing and counting the coins, via the coin interface 53.

Further, as shown in FIG. 4, a storage-medium writing unit 38 adapted for writing various kinds of information in a storage medium provided separately from the banknote recognition and counting machine 10 is connected with the control unit 50 of the banknote recognition and counting machine 10. In this case, the storage medium is composed of a publicly known medium or device, such as a floppy disk, a USB memory, a CD-ROM, a DVD or the like. This storage medium is detachably attached to the storage-medium writing unit 38. For instance, the storage-medium writing unit 38 is composed of a floppy disk drive, a USB memory drive, a CD-ROM drive, a DVD drive or the like. This storage-medium writing unit 38 may be provided to the casing 12 of the banknote recognition and counting machine 10, or otherwise may be provided separately from the casing 12.

Now, the operation of the banknote recognition and counting machine 10 constructed as described above will be discussed. It is noted that the operation of the banknote recognition and counting machine 10 as will be described below is performed by controlling each component of this machine 10 under the control of the control unit 50.

First, a basic operation (i.e., a counting operation for the banknotes) of the banknote recognition and counting machine 10 will be described.

First of all, the operator places the banknotes P to be respectively counted, on the placing unit 14, in the stacked condition. Thereafter, when the operator pushes down the START/STOP key 32*c* or 32*g* in the operation/display unit 32 and gives a command for starting the counting process for the banknotes P to the control unit 50, the banknotes P respectively placed in the stacked condition on the placing unit 14 are fed to the transport unit 22 in the casing 12, one by one, successively, by the feeding unit 16, from the banknote P located at the lowermost layer, and then transported by the transport unit 22. During this operation, the recognition process about the denomination of money, authenticity, fitness and the like of each banknote P and the counting process for the banknotes P are respectively performed by the recognition and counting unit 24. Then, the recognition result and count result on the banknotes P obtained by the recognition and counting unit 24 are respectively sent to the control unit 50.

In this case, each banknote P judged, as the genuine banknote, by the recognition and counting unit 24 is further transported by the transport unit 22 and fed to the stacking unit 26 by the diversion unit 31. During this operation, each banknotes P is fed, one by one, from the transport unit 22, to the stacking wheel 28*a*. This stacking wheel 28*a* receives each banknote P fed from the transport unit 22 between the two vanes 28*b* thereof, and then feeds this banknote P received between the two vanes 28*b* into the stacking unit 26. In this way, the banknotes P can be arranged in the stacking unit 26, by the stacking wheel 28*a*. Since the opening is provided in the front face of the stacking unit 26, the operator can take out such banknotes P respectively stacked in the stacking unit 26, via the opening.

Meanwhile, each banknotes P' not judged to be genuine by the recognition and counting unit 24 is further transported by the transport unit 22 and fed to the reject unit 30 by the diversion unit 31. Since the opening is provided in the front face of the reject unit 30, the operator can take out such banknotes P' respectively stacked in the reject unit 30, via the opening.

Next, the case of outputting the count result on the banknotes as well as outputting the count result on the coins, by using the banknote recognition and counting machine 10 provided for recognizing and counting the banknotes, as shown in FIGS. 1 through 4, will be described.

Namely, in the banknote recognition and counting machine 10 of this embodiment, the information concerning the count result on the banknotes P counted by the recognition and counting unit 24 can be fed to the control unit 50, as well as the information concerning the count result on the coins can be fed to the control unit 50 through the input unit. As used herein, the term "input unit" means the operation/display unit 32, coin interface 53 or the like. It is noted that a specific aspect for inputting the information to the control unit 50, by using such components, will be described later. Further, as used herein, the "count result on the coins" means a result obtained when the operator manually counts the coins, or result obtained by recognizing and counting the coins, by using the coin recognition and counting machine provided separately from the banknote recognition and counting machine 10. Then, the information concerning the count result on the banknotes P counted by the recognition and counting unit 24 and the information concerning the count result on the coins inputted to the control unit 50 can be outputted, respectively, from the output unit. As used herein, the term "output unit" means the display unit 32*p* of the operation/display unit 32, printing unit 34, external interface 52, storage-medium writing unit 38 or the like. It is noted that a specific aspect for outputting the information, by using such components, will be described later.

Now, referring to the flow chart of FIG. 5 as well as to the illustrations of FIGS. 6 and 7, the operation for outputting the count result on the banknotes as well as outputting the count result on the coins, by using the banknote recognition and counting machine 10 provided for recognizing and counting the banknotes, will be described in more detail.

First, the operator places the banknotes P to be respectively counted, on the placing unit 14, in the stacked condition. Then, the recognition and counting process for the banknotes P is performed in the banknote recognition and counting machine 10. More specifically, the banknotes P, respectively placed in the stacked condition on the placing unit 14, are fed, one by one, to the transport unit 22 in the casing 12, by the feeding unit 16, and then the recognition process about the denomination of money, authenticity, fitness and the like of each banknote P and the counting process for the banknotes P are respectively performed by the recognition and counting unit 24 (STEP 1 of FIG. 5). Thereafter, the recognition result and count result on the banknotes P, respectively recognized and counted by the recognition and counting unit 24, are respectively sent to the control unit 50. In this case, each banknote P judged as the genuine banknote, based on the recognition result sent from the recognition and counting unit 24, is further transported by the transport unit 22 and fed to the stacking unit 26 by the diversion unit 31. Meanwhile, each banknote P' not judged as the genuine banknote, based on the recognition result sent from the recognition and counting unit 24, is further transported by the transport unit 22 and fed to the reject unit 30 by the diversion unit 31.

Once the recognition and counting process for the banknotes P is performed, as described above, in the banknote recognition and counting machine 10, the count result on the banknotes, respectively judged as the genuine banknotes (i.e., the information on the total amount of money, e.g., 1,250 euros, of the counted banknotes P as well as on the number (PCS), e.g., 5 PCS, of the same banknotes P) and the country, from which such banknotes P are issued (this country may include a union of a plurality of countries, such as euro-zone countries (EUR) or the like), is displayed as shown in FIG. 6(*a*). In each of FIGS. 6(*a*) through 6(*f*), four function keys, i.e., an F1 (first function) key 32*j*, an F2 (second function) key 32*k*, an F3 (third function) key 32*l* and an F4 (fourth function) key 32*m*, are shown, for reference, in a right-adjacent section relative to the display unit 32*p*. Further, in each of FIGS. 6(*a*) through 6(*f*), various commands (e.g., MODE, MANUAL, DISPLAY, BATCH, arrows respectively indicating the upward direction and downward direction, and the like) are shown, respectively, in a left-adjacent portion, relative to the F1 key 32*j* to F4 key 32*m*, in the display unit 32*p*. In this case, each of such commands will be performed, when one of the four function keys 32*j* to 32*m* is pushed down.

Thereafter, the control unit 50 judges whether or not the input operation for the manually-obtained count result on the banknotes P is selected (STEP 2 of FIG. 5). Specifically, in the case some banknotes P' are fed to the reject unit 30, the operator manually performs the counting process, for the banknotes or the like other than the counterfeit banknotes among the banknotes P' fed to the reject unit 30, more specifically, for the banknotes not respectively judged as the genuine banknote because of transport errors or recognition errors, and then inputs the manually-obtained count result on such banknotes to the control unit 50, via the operation/display unit 32 (STEP 3 of FIG. 5). More specifically, in the case a screen as shown in FIG. 6(*a*) is displayed on the display unit 32*p*, when the operator pushes down the F2 key 32*k* in order to select a manual mode, the display on the display unit 32*p* is changed into the screen as shown in FIG. 6(*b*). In this case, upon the judgment whether or not the manually-obtained count result on the banknotes is inputted to the control unit 50, as shown in the STEP 2 of FIG. 5, when the operator pushes down the F2 key 32*k* to select the manual mode, the control unit 50 judges that an input operation for the manually-obtained count result on the banknotes has been selected.

Further, in the case the screen as shown in FIG. 6(*b*) is displayed on the display unit 32*p*, when the operator pushes down the F1 key 32*j* or F2 key 32*k* in the operation/display unit 32, a cursor is moved upward or downward. Namely, with this operation, the cursor will be moved to a display point for displaying any one of related denominations (e.g., 500, 200, 100, 50, 20, 10 and 5 (euros)). Thereafter, when the operator pushes down the F3 key 321, the manually-obtained count result on the banknotes P can be added, for each denomination of money, to the count result on the banknotes P obtained by the recognition and counting unit 24, i.e., the number of the banknotes P for each denomination of money. Meanwhile, when the operator pushes down the F4 key 32*m* in the operation/display unit 32, the number of the banknotes P, for each denomination of money, displayed on the screen shown in FIG. 6(*b*) is decreased. In this way, the information concerning the manually-obtained count result on the banknotes P is inputted to the control unit 50, via the operation/display unit 32.

Once the information concerning the manually-obtained count result on the banknotes P is inputted to the control unit 50, via the operation/display unit 32, the control unit 50 will judge whether or not the count result on the coins is inputted (STEP 4 of FIG. 5). As a result, when the control unit 50 judges that the count result on the coins is inputted to the control unit 50 (e.g., in such a case that the operator has manually performed the counting process for the coins, or the like), the operator will input the information concerning the manually-obtained count result on the coins to the control unit 50, via the operation/display unit 32 (STEP 5 of FIG. 5). More specifically, in the case the screen as shown in FIG. 6(*b*) is displayed on the display unit 32*p*, when the operator pushes down the F1 key 32*j*, while pushing down the SHIFT key 32*b* (at this time, when the SHIFT key 32*b* is pushed down, an indication of "COIN" is displayed, in a left-adjacent point relative to the F1 key 32*j*), and then selects an input mode for inputting the count result on the coins, the display on the display unit 32*p* is changed into the screen as shown in FIG. 6(*c*). Namely, upon the judgment on whether or not the count result on the coins is inputted to the control unit 50, as shown in the STEP 4 of FIG. 5, when the operator pushes down the F1 key 32*j*, while pushing down the SHIFT key 32*b*, and then selects the input mode for inputting the count result on the coins, the control unit 50 judges that the input operation for inputting the count result on the coins has been selected.

Further, in the case the screen as shown in FIG. 6(*c*) is displayed on the display unit 32*p*, when the operator pushes down the F1 key 32*j* or F2 key 32*k* in the operation/display unit 32, a cursor is moved upward or downward. Namely, with this operation, the cursor will be moved to the display point for displaying any one of the related denominations (i.e., 1, 0.5, 0.2, 0.1, 0.05, 0.02, 0.01 (euros)). Thereafter, when the operator pushes down the F3 key 321 in the operation/display unit 32, the manually-obtained count result on the coins can be increased, for each denomination of money. Meanwhile, when the operator pushes down the F4 key 32*m* in the operation/display unit 32, the number of the coins, for each denomination of money, displayed in the screen shown in FIG. 6(*c*) is decreased. In this way, the information concerning the manually-obtained count result on the coins is inputted to the control unit 50, via the operation/display unit 32.

It is noted that the method for inputting the information concerning the count result on the coins to the control unit 50 is not limited to such an aspect as described above. For instance, in place of using the method in which the operator manually performs the counting process for the coins and then inputs the manually-obtained count result on the coins to the control unit 50 via the operation/display unit 32, the coin recognition and counting machine adapted for recognizing and counting the coins may be connected with the coin interface 53 of the banknote recognition and counting machine 10, such that the information concerning the count result on the coins counted by the coin recognition and counting machine can be inputted to the control unit 50 via the coin interface 53. In this case, the need for the operator to perform the operation, via the operation/display unit 32, while watching this display unit 32*p*, can be eliminated.

Thereafter, when the operator pushes down the ACCEPT key 32*e* or 32*i* in the operation/display unit 32, a message or indication of "ACCEPTED" is displayed on the display unit 32*p*, as shown in FIG. 6(*d*). Thus, one transaction is accepted in the banknote recognition and counting machine 10 ("YES" in the STEP 6 of FIG. 5). Then, the count result on the banknotes P counted by the recognition and counting unit 24, the manually-obtained count result on the banknotes P inputted via the operation/display unit 32, and the count result on the coins inputted via the operation/display unit 32 or the like are respectively outputted (STEP 7 of FIG. 5). During this operation, the information concerning the total of the count result on the banknotes P and the count result on the coins may be outputted. In this case, in the total sum of the count result on the banknotes P and the count result on the coins, the information concerning the total amount of money and/or information concerning the number of such money (i.e., the banknotes P and coins) for each denomination thereof is outputted. However, in place of outputting the information concerning the total of the count result on the banknotes P and the count result on the coins, the count result on the banknotes P and the count result on the coins may be outputted, respectively.

In short, the information concerning the count result on the banknotes P and/or coins is displayed on the display unit 32*p* of the operation/display unit 32. More specifically, as shown in FIG. 6(*e*), the number of the banknotes P for each denomination of money and the total amount of money of the banknotes P and coins (T. TOTAL (TRANSACTION TOTAL): 1,250.52 euros) are displayed, respectively. Thereafter, in the state the screen as shown in FIG. 6(*e*) is displayed on the display unit 32*p*, when the F1 key 32*j* is pushed down in order to switch the screens, the display on the display unit 32*p* is changed into the screen as shown in FIG. 6(*f*). Thus, the number of the coins for each denomination of money and the total amount of money of the banknotes P and coins are displayed, respectively. In this case, in addition to the display of the information concerning the count result on the banknotes P or coins on the display unit 32*p*, or in place of the display of the information concerning the count result on the banknotes P or coins on the display unit 32*p*, the information concerning the count result on the banknotes P or coins may be printed on the printing unit 34, such as the printer or the like. In this case, as shown in FIG. 7, the number for each denomination of money and total amount of money of the banknotes P, the number for each denomination of money and total amount of money of the coins, and the total amount of money of the banknotes P and coins are printed, respectively.

Further, the information concerning the count result on the banknotes P or coins may be sent to the higher-ranking machine, such as the host computer or the like, via the external interface 52. In addition, the information concerning the count result on the banknotes P or coins may be stored in the memory unit 36. In this case, the memory unit 36 is composed of a first memory part 36*a* adapted for storing therein the information concerning the count result on the banknotes P respectively counted by the recognition and counting unit 24, and a second memory part 36*b* adapted for storing therein the information concerning the count result on the coins inputted via the operation/display unit 32 or the like. Namely, in this case, the information concerning the count results on the banknotes P and coins is stored, separately, in the corresponding memory unit parts 36*a*, 36*b*. For instance, two hard disks or the like are provided in the casing 12, and one hard disk is provided as the first memory part 36*a*, and the other hard disk is provided as the second memory part 36*b*. Further, the information concerning the count result on the banknotes P or coins may be written in the storage medium by the storage-medium writing unit 38, when this storage medium is inserted in the storage-medium writing unit 38.

In this way, once the information concerning the count result on the banknotes P or coins is outputted by the display unit 32*p*, printing unit 34, external interface 52, storage-medium writing unit 38 or the like, a series of operations in the banknote recognition and counting machine 10 is ended.

If required, in the series of operations in the banknote recognition and counting machine 10 as shown in the flow chart of FIG. 5, the step (STEP 2) for judging whether or not the manually-obtained count result on the banknotes is inputted, and the step (STEP 3) for inputting the information concerning the manually-obtained recognition result on the banknotes P via the operation/display unit 32 may be omitted respectively. In this case, however, once the recognition and counting process for the banknotes P is performed by the recognition and counting unit 24, only the information concerning the count result on the coins will be inputted to the control unit 50.

As stated above, according to the banknote recognition and counting machine 10 of this embodiment, the information concerning the count result on the coins is inputted through the input unit, and then the information concerning the count result on the coins inputted through the input unit is sent to the control unit 50. Thereafter, the information concerning the count result on the banknotes P counted by the recognition and counting unit 24 and the information concerning the count result on the coins inputted through the input unit are respectively outputted from the output unit. Further, according to the money counting method of this embodiment, the recognition and counting process is performed, for the banknotes P respectively put from the outside into the casing 12 of the banknote recognition and counting machine 10, by the recognition and counting unit 24, while the information concerning the count result on the coins is inputted through the input unit. Then, the information concerning the count result on the banknotes P counted by the recognition and count unit 24 and the information concerning the count result on the coins inputted through the input unit are respectively outputted through the output unit. Thus, according to this banknote recognition and counting machine 10 and/or money counting method, the count result on the banknotes P can be outputted, as well as the count result on the coins can be outputted, by using the banknote recognition and counting machine 10 provided for recognizing and counting the banknotes P. As such, both of the information concerning the count result on the banknotes P and the information concerning the count result on the coins can be outputted, without the need for providing the external machine, such as the personal computer or the like.

For instance, the input unit is composed of the operation/display unit 32 provided to an outer face of the casing 12 and adapted for allowing a necessary command to be inputted to the control unit. Alternatively, the input unit may be composed of the coin interface 53, which is connected, for communication, with the coin recognition and counting machine provided for recognizing and counting the coins, and is adapted for receiving the information concerning the count result on the coins from the coin recognition and counting machine. Further, as the input unit, any other suitable unit than the operation/display unit 32 or coin interface 53 may be used.

The output unit is composed of the display unit 32*p* adapted for displaying the information concerning the count result on the banknotes P counted by the recognition and count unit 24 and the information concerning the count result on the coins inputted through the input unit, or composed of the printing unit 34, such as the printer or the like, adapted for printing the information concerning the count result on the banknotes P counted by the recognition and count unit 24 and the information concerning the count result on the coins inputted through the input unit. Otherwise, the output unit may be composed of the external interface 52 connected, for communication, with the external machine and adapted for sending the information concerning the count result on the banknotes P counted by the recognition and count unit 24 and the information concerning the count result on the coins inputted through the input unit, to the higher-ranking machine. Further, the output unit may be composed of the storage-medium writing unit 38 adapted for writing the information concerning the count result on the banknotes P counted by the recognition and count unit 24 and the information concerning the count result on the coins inputted through the input unit, in the external storage medium. In addition, as the output unit, any other suitable unit than the display unit 32*p*, printing unit 34, external interface 52 and storage-medium writing unit 38 may be used.

Further, the output unit may be provided for outputting the information concerning the total of the count result on the banknotes P counted by the recognition and count unit 24 and the count result on the coins inputted through the input unit. In this case, the output unit may be provided for outputting the information concerning the total amount of money (see "1,250,52 euros" shown in FIGS. 6(*e*), 6(*f*) and 7) or information concerning the total number of the money for the each denomination of money (see FIG. 7), in the information concerning the total of the count result on the banknotes P counted by the recognition and count unit 24 and the count result on the coins inputted through the input unit. Alternatively, in place of outputting the information concerning the total of the count result on the banknotes P counted by the recognition and count unit 24 and the count result on the coins inputted through the input unit, the output unit may be provided for outputting the count result on the banknotes P counted by the recognition and count unit 24 and the count result on the coins inputted through the input unit, separately from each other.

Further, as shown in the STEP 2 and STEP 3 of FIG. 5, the input unit, such as the operation/display unit 32 or the like, may be provided for allowing the information concerning the manually-obtained count result on the banknotes P' that cannot be recognized by the recognition and counting unit 24, to be inputted, in addition to the information concerning the count result on the coins.

Further, the memory unit 36 may store therein the information concerning the count result on the banknotes P counted by the recognition and counting unit 24 and the count result on the coins inputted through the input unit. In this case, the memory unit 36 is composed of the first memory part 36*a* adapted for storing therein the information concerning the count result on the banknotes P respectively counted by the recognition and counting unit 24, and the second memory part 36*b* adapted for storing therein the information concerning the count result on the coins inputted through the input unit.

The invention claimed is:

1. A banknote recognition and counting machine configured to recognize and count one or more banknotes, the machine comprising:

a casing;

a recognition and counting unit provided in the casing and configured to recognize and count one or more banknotes, put from the outside into the casing;

a control unit connected with the recognition and counting unit and configured to receive a count result on one or more banknotes, sent from the recognition and counting unit;

an input unit connected with the control unit and configured to allow information concerning a count result on coins to be inputted, the information concerning the count result on the coins, that has been inputted through the input unit, being sent to the control unit; and an output unit connected with the control unit and configured to output information concerning the count result on one or more banknotes counted by the recognition and counting unit and the information concerning the count result on the coins inputted through the input unit;

wherein the input unit is an operation unit, from which an operator sends a command to the control unit; and wherein the count result on the coins is manually obtained such that the operation unit sends the manually-obtained count result on coins to the control unit.

2. The banknote recognition and counting machine according to claim 1, wherein the output unit is configured to output information concerning the total of the count result on one or more banknotes counted by the recognition and counting unit and the count result on the coins inputted through the input unit.

3. The banknote recognition and counting machine according to claim 2, wherein the output unit is configured to output information concerning the total amount of money and/or information concerning the total number of money by denomination, in the total of the count result on one or more banknotes counted by the recognition and counting unit and the count result on the coins, inputted through the input unit.

4. The banknote recognition and counting machine according to claim 1, wherein the input unit is capable of allowing the information concerning a manually-obtained count result on one or more banknotes that cannot be recognized by the recognition and counting unit, to be inputted, in addition to the information concerning the count result on the coins.

5. The banknote recognition and counting machine according to claim 1, further comprising a memory unit connected with the control unit and configured to store therein the information concerning the count result on one or more banknotes counted by the recognition and counting unit and the information concerning the count result on the coins inputted through the input unit.

6. The banknote recognition and counting machine according to claim 5, wherein the memory unit includes a first memory part configured to store therein the information concerning the count result on one or more banknotes counted by the recognition and counting unit, and a second memory part configured to store therein the information concerning the count result on the coins, inputted through the input unit.

7. The banknote recognition and counting machine according to claim 1, wherein the output unit includes any one of: a display unit configured to display the information concerning the count result on one or more banknotes counted by the recognition and counting unit and the information concerning the count result on the coins inputted through the input unit; a printing unit configured to print the information concerning the count result on one or more banknotes counted by the recognition and counting unit and the information concerning the count result on the coins inputted through the input unit; an external interface unit connected, for communication, with an external machine and configured to send the information concerning the count result on one or more banknotes counted by the recognition and counting unit and the information concerning the count result on the coins inputted through the input unit, to the external machine; and a storage-medium writing unit configured to write the information concerning the count result on one or more banknotes counted by the recognition and counting unit and the information concerning the count result on the coins inputted through the input unit, in an external storage medium.

8. A money counting method for counting money by using a banknote recognition and counting machine configured to recognize and count one or more banknotes, the method comprising:

recognizing and counting one or more banknotes, put from the outside into a casing of the banknote recognition and counting machine, by using a recognition and counting unit;

inputting information concerning a count result on coins, through an operation unit, from which an operator sends a command; and outputting information concerning a count result on one or more banknotes counted by the recognition and counting unit and the information concerning the count result on the coins inputted through the operation unit, through an output unit;

wherein the count result on the coins is manually obtained, such that the operation unit sends the manually-obtained count result on coins to a control unit.

* * * * *